US009685173B2

(12) United States Patent
Sharma et al.

(10) Patent No.: US 9,685,173 B2
(45) **Date of Patent: *Jun. 20, 2017**

(54) METHOD FOR NON-INTRUSIVE ACOUSTIC PARAMETER ESTIMATION

(71) Applicant: NUANCE COMMUNICATIONS, INC., Burlington, MA (US)

(72) Inventors: Dushyant Sharma, Marlow (GB); Patrick Naylor, Reading (GB); Pablo Peso Parada, Maidenhead (GB)

(73) Assignee: Nuance Communications, Inc., Burlington, MA (US)

( * ) Notice: Subject to any disclaimer, the term of this patent is extended or adjusted under 35 U.S.C. 154(b) by 6 days.

This patent is subject to a terminal disclaimer.

(21) Appl. No.: 14/138,944

(22) Filed: Dec. 23, 2013

(65) Prior Publication Data

US 2015/0073780 A1 Mar. 12, 2015

Related U.S. Application Data

(63) Continuation-in-part of application No. 14/019,860, filed on Sep. 6, 2013.

(51) Int. Cl.

| | |
|---|---|
| ***G10L 21/00*** | (2013.01) |
| ***G10L 25/12*** | (2013.01) |
| ***G10L 25/60*** | (2013.01) |

(52) U.S. Cl.

CPC ..... *G10L 25/12* (2013.01); *G10L 25/60* (2013.01)

(58) Field of Classification Search

USPC ..... 704/205–207, 230

See application file for complete search history.

(56) References Cited

U.S. PATENT DOCUMENTS

| | | | | |
|---|---|---|---|---|
| 7,672,838 | B1 | 3/2010 | Athineos et al. | |
| 7,856,355 | B2 * | 12/2010 | Kim | G10L 25/69 702/69 |
| 2004/0153315 | A1 | 8/2004 | Reynolds et al. | |
| 2005/0131696 | A1 * | 6/2005 | Wang et al. | 704/268 |
| 2007/0011006 | A1 * | 1/2007 | Kim | H04M 3/2236 704/233 |
| 2007/0127688 | A1 | 6/2007 | Doulton | |
| 2008/0201138 | A1 * | 8/2008 | Visser et al. | 704/227 |

(Continued)

FOREIGN PATENT DOCUMENTS

KR 100875936 B1 12/2008

OTHER PUBLICATIONS

Non-Final Office Action in related U.S. Appl. No. 14/019,860, mailed May 4, 2015, 14 pages.

(Continued)

*Primary Examiner* — Leonard Saint Cyr

(74) *Attorney, Agent, or Firm* — Mark H. Whittenberger, Esq.; Holland & Knight LLP

(57) ABSTRACT

A system and method for non-intrusive acoustic parameter estimation is included. The method may include receiving, at a computing device, a first speech signal associated with a particular user. The method may include extracting one or more short-term features from the first speech signal. The method may also include determining one or more statistics of each of the one or more short-term features from the first speech signal. The method may further include classifying the one or more statistics as belonging to one or more acoustic parameter classes.

15 Claims, 9 Drawing Sheets

(56) References Cited

U.S. PATENT DOCUMENTS

| | | | | |
|---|---|---|---|---|
| 2008/0219458 | A1* | 9/2008 | Brooks et al. | 381/57 |
| 2009/0018825 | A1 | 1/2009 | Bruhn et al. | |
| 2009/0127688 | A1 | 5/2009 | Lee et al. | |
| 2009/0271182 | A1 | 10/2009 | Athineos et al. | |
| 2010/0226492 | A1* | 9/2010 | Takada | 379/406.08 |
| 2011/0150067 | A1* | 6/2011 | Takada | 375/227 |
| 2011/0288865 | A1* | 11/2011 | Chan | G10L 25/69 704/240 |
| 2011/0295607 | A1 | 12/2011 | Krishnan et al. | |
| 2012/0052448 | A1 | 3/2012 | Gyoda et al. | |
| 2012/0116759 | A1 | 5/2012 | Folkesson et al. | |
| 2012/0294164 | A1 | 11/2012 | Leventu | |
| 2013/0095799 | A1* | 4/2013 | Shaffer et al. | 455/413 |
| 2013/0096922 | A1* | 4/2013 | Asaei et al. | 704/270 |
| 2013/0262096 | A1 | 10/2013 | Wilhelms-Tricarico | |
| 2014/0201276 | A1* | 7/2014 | Lymberopoulos et al. | 709/204 |
| 2014/0358526 | A1* | 12/2014 | Abdelal | G10L 25/69 704/202 |
| 2015/0073785 | A1 | 3/2015 | Sharma et al. | |

OTHER PUBLICATIONS

Final Office Action in related U.S. Appl. No. 14/019,860, mailed Oct. 1, 2015, 13 pages.

Advisory Action in related U.S. Appl. No. 14/019,860, mailed Feb. 11, 2016, 3 pages.

Non-Final Office Action in related U.S. Appl. No. 14/019,860, mailed Apr. 7, 2016, 25 pages.

Notification Concerning Transmittal of International Preliminary Report on Patentability, received in International Patent Application No. PCT/US2014/050703, dated Mar. 17, 2016, including Written Opinion, dated Nov. 14, 2014, (8 pages).

Final Office Action in related U.S. Appl. No. 14/019,860, mailed Sep. 19, 2016, 18 pages.

Notification of Transmittal of the International Search Report and the Written Opinion of the International Search Authority or the Declaration issued in corresponding International Application No. PCT/US2014/05073, mailed on Nov. 14, 2014 (12 pages).

Bouzid, Merouane, "Efficient Encoding of the MELP LSF Parameters: Application of the Switched Split Vector Quantization," International Conference on Computer and Information Application (ICCIA) 2010, Tinjin, IEEE 2010, pp. 259-262, (Dec. 3-5, 2010), (only p. 259 is being supplied herewith).

Muda, Lindasalwa, "Voice Recognition Algorithms Using Mel Frequency Cepstral Coefficient (MFCC) and Dynamic Time Warping (DTW) Techniques," Journal of Computing, vol. 2, Issue 3, pp. 138-143 (Mar. 2010), (downloaded from "http://arxiv.org/ftp/arxiv/papers/1003/1003.4083.pdf").

Fukamori et al.; "Performance Estimation of Reverberant Speech Recognition Based on Reverberant Criteria RSR-Dn with Acoustic Parameters"; Interspeech 2010; Sep. 26-30, 2010; Makuhari, Chiba, Japan.

Couvreur et al.; "Blind Model Selection for Automatic Speech Recognition in Reverberant Environments"; Mar. 22, 2004.

Non-Final Office Action in related U.S. Appl. No. 14/019,860, mailed Mar. 23, 2017, 14 pages.

* cited by examiner

200

300

400

800

METHOD FOR NON-INTRUSIVE ACOUSTIC PARAMETER ESTIMATION

RELATED APPLICATIONS

The subject application is a continuation-in-part application of U.S. Patent Application with Ser. No. 14/019,860, filed on Sep. 6, 2013, the entire content of which is herein incorporated by reference.

TECHNICAL FIELD

This disclosure relates generally to a method for non-intrusive classification of speech quality.

BACKGROUND

Speech quality is a judgment of a perceived multidimensional construct that is internal to the listener and is typically considered as a mapping between the desired and observed features of the speech signal. Speech quality assessment may be used for analyzing the perceptual effects of various degradations on a speech signal. These degradations may be caused when speech processing systems are deployed in non-ideal operating conditions and the problem is compounded further by the increasing complexity and non-linear processing integrated into modern communication systems. In the telecommunications industry, such degradations impact the quality of service of a system and objective techniques for speech quality assessment may be used for optimizing network parameters, capacity management and cost optimization based on customer experience.

The quality of a speech signal (e.g. a voicemail) may be obtained in a listening test with a number of human subjects (subjective methods) or algorithmically (objective methods). As the quality of a speech signal is a highly subjective measure, a number of techniques for subjective speech quality assessment have been proposed. The International Telecommunication Union (ITU) standard outlines a number of protocols for carrying out subjective quality experiments on various measurement scales. There are broadly two types of subjective tests, one where the subjects rate the absolute quality of a signal (absolute rating) and the other where subjects provide a preference for one of a pair of signals (preference rating). A frequently used rating scale for absolute rating is the 5-point Absolute Category Rating (ACR) listening quality scale.

Although it is possible to get accurate results with subjective testing for small quantities of data (and are believed to give the true speech quality), they are time consuming and expensive to administer for large amounts of audio and thus unsuitable for real-time (or even near real-time) applications. The objective methods for speech quality assessment aim to overcome these issues by modeling the relationship between the desired and perceived characteristics of the signal algorithmically, without the use of listeners.

SUMMARY OF DISCLOSURE

In one implementation, a method for speech quality detection is provided. The method may include receiving, at a computing device, a first speech signal associated with a particular user. The method may include extracting one or more short-term features from the first speech signal. The method may also include determining one or more statistics of each of the one or more short-term features from the first speech signal. The method may further include classifying the one or more statistics as belonging to one or more acoustic parameter classes.

One or more of the following features may be included. In some embodiments, the one or more short term features may include a line spectral frequency feature. The line spectral frequency feature may be based upon, at least in part, a linear predictive coding coefficient. The one or more short term features may include a mel-frequency cepstral coefficient feature. The one or more short term features may include at least one of a velocity feature and an acceleration feature. The velocity feature and/or the acceleration feature may be computed using a fast fourier transform. The method may further include extracting one or more long-term features from the first speech signal. The long-term features may include a feature based upon, at least in part, a Hilbert phase calculation. In some embodiments, the one or more acoustic parameter classes may include a room acoustic parameter class.

In another implementation, a system is provided. The system may be used for converting speech to text using voice quality detection. The system may include one or more processors configured to receive a first speech signal associated with a particular user. The one or more processors may be further configured to extract one or more short-term features from the first speech signal. The one or more processors may be further configured to determine one or more statistics of each of the one or more short-term features from the first speech signal. The one or more processors may be further configured to classify the one or more statistics as belonging to one or more acoustic parameter classes.

One or more of the following features may be included. In some embodiments, the one or more short term features may include a line spectral frequency feature. The line spectral frequency feature may be based upon, at least in part, a linear predictive coding coefficient. The one or more short term features may include a mel-frequency cepstral coefficient feature. The one or more short term features may include at least one of a velocity feature and an acceleration feature. The velocity feature and/or the acceleration feature may be computed using a fast fourier transform. The one or more processors may be further configured to extract one or more long-term features from the first speech signal. The long-term features may include a feature based upon, at least in part, a Hilbert phase calculation. In some embodiments, the one or more acoustic parameter classes may include a room acoustic parameter class.

In another implementation, a non-transitory computer-readable storage medium is provided. The non-transitory computer-readable storage medium may have stored thereon instructions, which when executed by a processor result in one or more operations. The operations may include receiving, at a computing device, a first speech signal associated with a particular user. Operations may further include extracting one or more short-term features from the first speech signal. Operations may also include determining one or more statistics of each of the one or more short-term features from the first speech signal. Operations may further include classifying the one or more statistics as belonging to one or more acoustic parameter classes.

One or more of the following features may be included. In some embodiments, the one or more short term features may include a line spectral frequency feature. The line spectral frequency feature may be based upon, at least in part, a linear predictive coding coefficient. The one or more short term features may include a mel-frequency cepstral coefficient feature. The one or more short term features may include at least one of a velocity feature and an acceleration feature. The velocity feature and/or the acceleration feature may be computed using a fast fourier transform. Operations may further include extracting one or more long-term features from the first speech signal. The long-term features may include a feature based upon, at least in part, a Hilbert phase calculation. In some embodiments, the one or more acoustic parameter classes may include a room acoustic parameter class.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings may indicate like elements.

DETAILED DESCRIPTION OF THE EMBODIMENTS

Embodiments provided herein are directed towards a system and method for speech quality detection (e.g. in a voicemail to text application). In some embodiments, the speech classification process of the present disclosure may be used to non-intrusively (i.e., without a reference signal) classify the acoustic quality of speech into N classes. Accordingly, the speech classification process may be used to set more appropriate customer expectation for automatic speech recognition ("ASR") conversion, efficiently control the speech to text process pipeline. For example, in a voicemail system, the teachings of the present disclosure may help in monitoring voice quality from numerous carriers.

Figure 1:
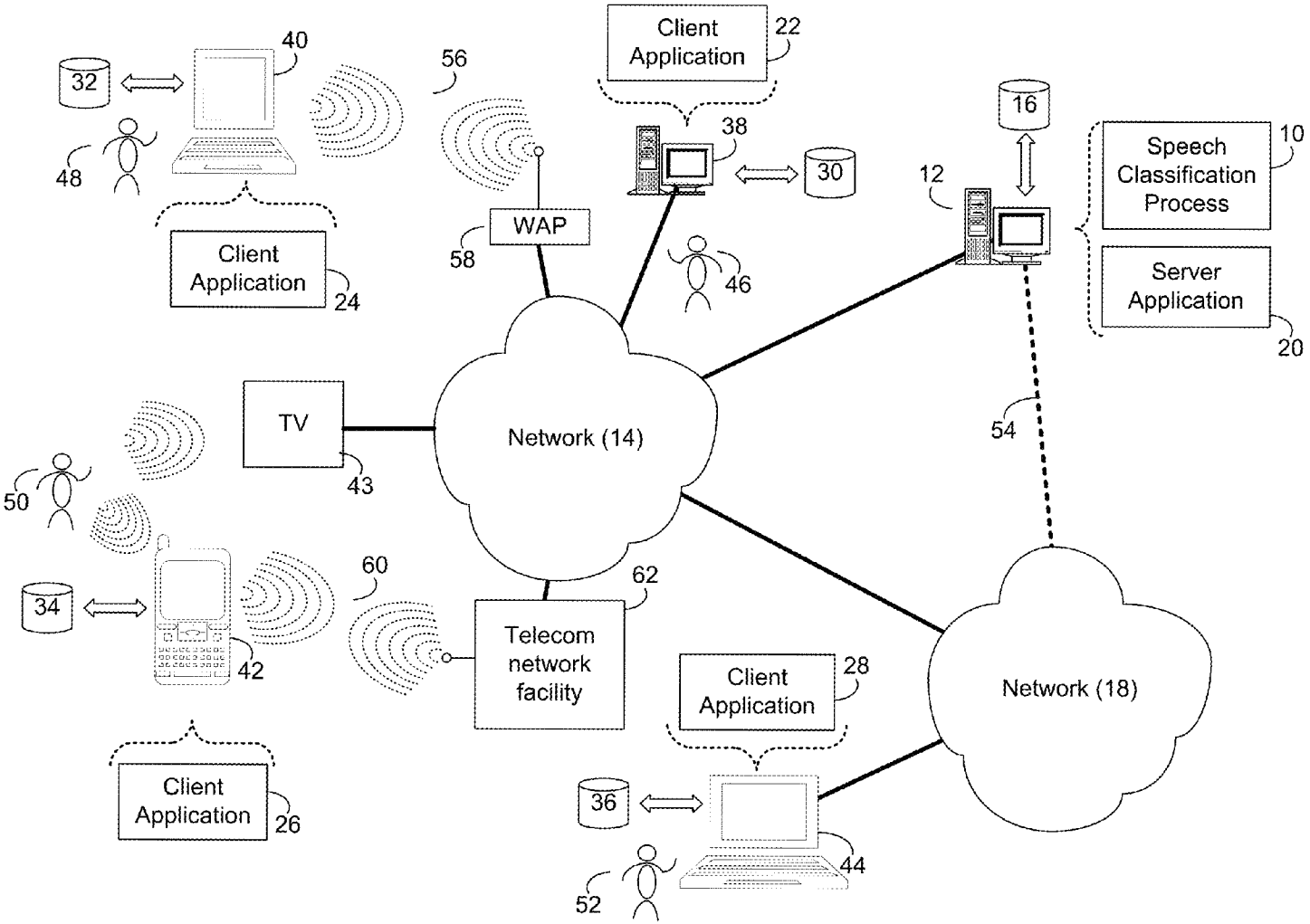
FIG. 1 is a diagrammatic view of an example of a speech classification process in accordance with an embodiment of the present disclosure.

Referring to FIG. 1, there is shown a speech classification process 10 that may reside on and may be executed by computer 12, which may be connected to network 14 (e.g., the Internet or a local area network). Server application 20 may include some or all of the elements of speech classification process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example.

As will be discussed below in greater detail in FIGS. 2-7, speech classification process 10 may include receiving (602), at a computing device, a first speech signal associated with a particular voicemail from a user. The method may further include extracting (604) one or more short-term features from the first speech signal wherein extracting short-term features includes extracting a time frame of between 10-50 ms. The method may also include determining (606) one or more statistics of each of the one or more short-term features from the first speech signal. The method may further include classifying (608) the one or more statistics as belonging to one of a set of quality classes.

The instruction sets and subroutines of speech classification process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

In some embodiments, speech classification process 10 may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), a dedicated network device (not shown), etc.

One or more of client applications 22, 24, 26, 28 may be configured to effectuate some or all of the functionality of speech classification process 10. Accordingly, speech classification process 10 may be a purely server-side application, a purely client-side application, or a hybrid server-side/client-side application that is cooperatively executed by one or more of client applications 22, 24, 26, 28 and speech classification process 10.

Client electronic devices 38, 40, 42, 44 may each execute an operating system, examples of which may include but are not limited to Apple iOS™, Microsoft Windows™, Android™, Redhat Linux™, or a custom operating system.

Users 46, 48, 50, 52 may access computer 12 and speech classification process 10 directly through network 14 or through secondary network 18. Further, computer 12 may be connected to network 14 through secondary network 18, as illustrated with phantom link line 54. In some embodiments, users may access speech classification process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14.

The phrase "telecommunications network facility", as used herein, may refer to a facility configured to transmit, and/or receive transmissions to/from one or more mobile devices (e.g. cellphones, etc). In the example shown in FIG. 1, telecommunications network facility 62 may allow for communication between any of the computing devices shown in FIG. 1 (e.g., between cellphone 42 and server computing device 12).

Figure 2:
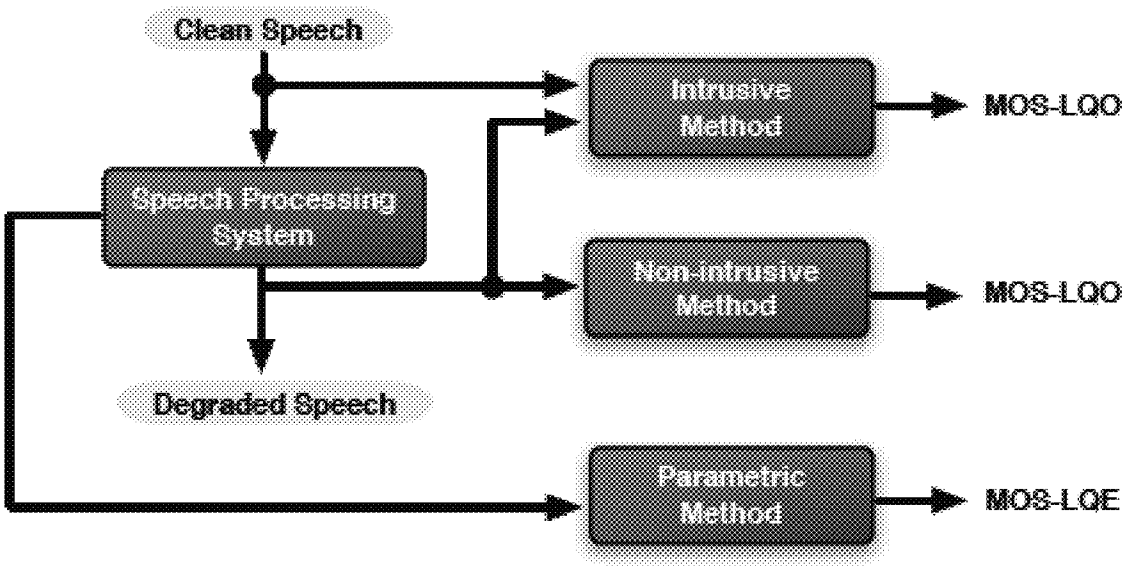
FIG. 2 is a diagrammatic view of an example of a speech classification process in accordance with an embodiment of the present disclosure.

Referring now to FIG. 2, an embodiment of speech classification process 10 depicting both intrusive and non-intrusive objective speech assessment techniques is provided. There are three main categories of objective speech quality assessment, those which require a reference (unprocessed) signal in addition to the received (processed) signal are referred to as intrusive techniques, those that rely only on the received signal are referred to as non-intrusive techniques and those that rely on the parameters of the processing system are commonly referred to as parametric techniques. The quality score estimated with an intrusive or non-intrusive technique is referred as Mean Opinion Score for Objective Listening Quality (MOS-LQO) and when a parametric method is used, it is known as Mean Opinion Score Estimated with a Parametric Listening Quality algorithm (MOS-LQE). The parametric methods estimate speech quality by measuring various properties of the transmission system under test and require a full characterization of the system.

Although certain embodiments discussed herein may involve voicemail applications, the teachings of the present disclosure are not limited to these examples. They are provided merely by way of example and are not intended to limit the speech to text based applications included herein.

Intrusive methods may be used where access to a clean signal is possible, such as CODEC development or for assessing the quality of a communication system with known test signals. An ITU industry standard for intrusive quality testing is the Perceptual Evaluation of Speech Quality measure, which has been further extended for the assessment of wide-band telephone networks and speech CODECs. In PESQ, quality scores are determined on a scale from −0.5 to 4.5 and a mapping function is then used to map the PESQ score to mean opinion scores (MOS). More recently, an extension of PESQ has been standardized as Perceptual Objective Listening Quality Assessment ("POLQA").

When a clean speech signal is not available, a non-intrusive technique may be applied. The current ITU-T industry standard algorithm for non-intrusive speech quality assessment is the P.563, which uses a number of features from the audio stream to estimate the quality directly on the MOS scale. More recently, a number of data-driven methods have been proposed that derive a number of features from the speech signal and use a previously trained model to map the features to a quality score. A number of techniques that use machine learning models such as GMMs to model perceptual speech features such as the Perceptual Linear Prediction (PLP) coefficients have been proposed as well. Additionally, speech quality measures based on a data-mining approach using CART regression trees have also been developed. The Low Complexity Quality Assessment (LCQA) algorithm derives a number of features from the speech signal and has been shown to outperform the P.563 measure for a large set of degradations.

Figure 3:
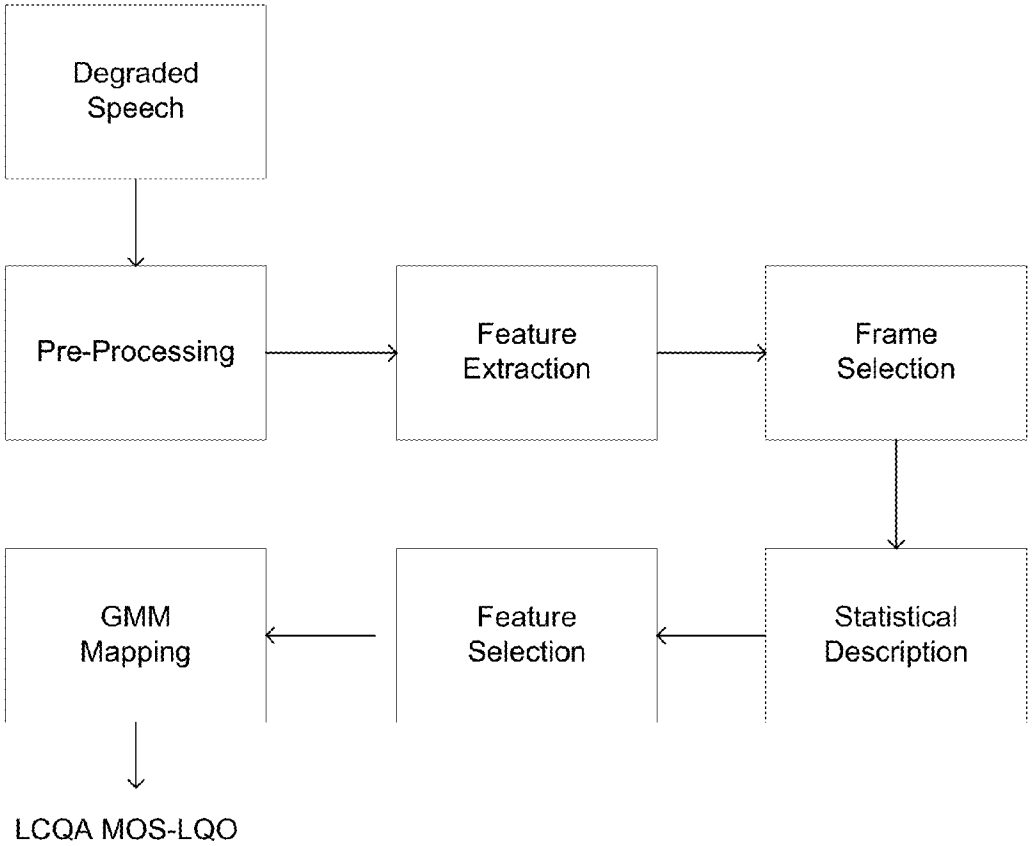
FIG. 3 is a diagrammatic view of an example of a speech classification process.

Referring now to FIG. 3, an example depicting an LCQA approach is provided. The LCQA method is a machine learning approach to non-intrusive speech quality assessment and has been shown to outperform the P.563 method for a number of speech databases. See, V Grancharov, D. Y. Zhao, J. Lindblom, and W. B. Klein, "*Low-complexity, nonintrusive speech quality assessment," IEEE Trans. Audio, Speech, Lang. Process.*, vol. 14, no. 6, pp. 1948-1956, November 2006. The LCQA algorithm may begin with a pre-processing stage that splits the input signal into 20 ms non-overlapping frames for further processing. The remaining aspects of the algorithm (e.g. feature extraction, statistical description, and GMM mapping) are described in further detail below.

In some embodiments, the LCQA algorithm may extract a number (e.g. 11) features per frame (denoted as ø in Table 1 shown below). The pitch period may be extracted by an autocorrelation based method and the spectral features may be derived from a 10th order LPC analysis of the speech signal. The spectral flatness feature for time frame i may be calculated as:

$$\phi_1(i) = \frac{\exp\left(\frac{1}{N_k}\sum_{k=1}^{N_k}\log(P_{LPC}(i,k))\right)}{\frac{1}{N_k}\sum_{k=1}^{N_k}P_{LPC}(i,k)}, \tag{1}$$

where $P_{LPC}(i, k)$ is the frequency response (frequency index k) of the LPC model magnitude spectrum, defined as:

$$P_{LPC}(i,k) = \frac{1}{\left|1 + \sum_{m=1}^{p} a_m e^{-jkm}\right|^2} \tag{2}$$

Similarly, the spectral dynamics ($\varnothing_2$(i)) and spectral centroid ($\varnothing_3$(i)) features for the $i^{th}$ time frame are calculated as:

$$\phi_2(i) = \frac{1}{N_k}\sum_{k=1}^{N_k} (\log P_{LPC}(i,k) - \log(P_{LPC}(i,k)))^2, \tag{3}$$

$$\phi_3(i) = \frac{\sum_{k=1}^{N_k} \omega(k) \times \log(P_{LD}(i,k))}{\sum_{k=1}^{N_k} \log(P_{LD}(i,k))}, \tag{4}$$

where ω(k) is the frequency vector (e.g. a vector containing the center frequency of each FFT bin).

In addition to the 6 basic features, the rate of change of these over all time frames is also computed (see Table 1). The next step is a frame selection procedure which applies thresholds on three per-frame features ($\varnothing_1$, $\varnothing_2$, $\varnothing_5$) and retains only those frames that qualify this threshold. This is done to remove unnecessary frames (e.g. those frames that do not help improve the RMSE performance of the algorithm on the training data by a predetermined threshold) from the signal. This has been described as a generalization of a Voice Activity Detector (VAD) and typically discards between 50% to 80% of the frames. The new set of frames is denoted by $\ddot{\Omega}$.

From a statistical standpoint, the 11 per-frame features are described by their mean, variance, skewness and kurtosis as follows:

$$\mu(\phi_j) = \frac{1}{N_{\ddot{\Omega}}}\sum_{i\in\ddot{\Omega}} \phi_j(i)), \tag{5}$$

$$\sigma(\phi_j) = \frac{1}{N_{\ddot{\Omega}}}\sum_{i\in\ddot{\Omega}} (\phi_j(i) - \mu(\phi_j))^2, \tag{6}$$

$$\gamma(\phi_j) = \frac{1}{N_{\ddot{\Omega}}}\frac{\sum_{i\in\ddot{\Omega}} (\phi_j(i) - \mu(\phi_j))^3}{\sigma^{3/2}(\phi_j)}, \tag{7}$$

$$K(\phi_j) = \frac{1}{N_{\ddot{\Omega}}}\frac{\sum_{i\in\ddot{\Omega}} (\phi_j(i) - \mu(\phi_j))^4}{\sigma^{2}(\phi_j)}, \tag{8}$$

where $\varnothing_j$ is the $j^{th}$ feature and $N_{\ddot{\Omega}}$ are the number of frames that are selected. The resulting 44 dimensional global feature vector (ϕ) is used to perform feature subset selection using the Sequential Floating Backward Selection (SFBS) procedure on labeled training data. The resulting feature set ($\hat{\phi}$) may be used for the GMM mapping stage.

In some embodiments, for GMM mapping, the final quality estimate may be obtained with a GMM mapping using final global features for the current signal and a trained GMM.

$$E(\theta \mid \hat{\varphi}) = \sum_{m=1}^{M} u^{(m)}(\varphi)\mu^{(m)}(\theta \mid \hat{\varphi}), \tag{9}$$

where $$\mu^{(m)}(\hat{\varphi}) = \frac{w_m \times N\left(\hat{\varphi} \mid \mu_{\hat{\varphi}}^{(m)}, \sum_{\hat{\varphi}\hat{\varphi}}^{(m)}\right)}{\sum_{k=1}^{M} w_k \times N\left(\hat{\varphi} \mid \mu_{\hat{\varphi}}^{(m)}, \sum_{\hat{\varphi}\hat{\varphi}}^{(m)}\right)} \tag{10}$$

$$\mu^{(m)}(\theta \mid \hat{\varphi}) = \mu^{(m)}(\theta) + \sum_{\hat{\varphi}\theta}^{(m)} \left(\sum_{\hat{\varphi}\hat{\varphi}}^{(m)}\right)^{-1} (\hat{\varphi} - \mu^{(m)}(\hat{\varphi})), \tag{11}$$

where $N(\hat{\phi}|\mu_{\hat{\phi}}^{(m)}, \Sigma_{\hat{\phi}\hat{\phi}}^{(m)})$ is a multivariate Gaussian density and w is the mixture coefficient vector, $\mu^{(m)}(\theta)$ and $u^{(m)}(\hat{\phi})$ are the means of the quality and feature vectors, $\Sigma_{\hat{\phi}\hat{\phi}}^{(m)}$ is the feature covariance matrix and $\Sigma_{\hat{\phi}\theta}^{(m)}$ is the cross-covariance matrix of the $m^{th}$ mixture.

TABLE 1

The 11 per-frame features used in the LCQA algorithm

| Feature description | Feature | Rate of change of feature |
|---|---|---|
| Spectral flatness | $\varnothing_1$ | $\varnothing_7$ |
| Spectral dynamics | $\varnothing_2$ | — |
| Spectral centroid | $\varnothing_3$ | $\varnothing_8$ |
| Excitation variance | $\varnothing_4$ | $\varnothing_9$ |
| Speech variance | $\varnothing_5$ | $\varnothing_{10}$ |
| Pitch period | $\varnothing_6$ | $\varnothing_{11}$ |

Figure 4:
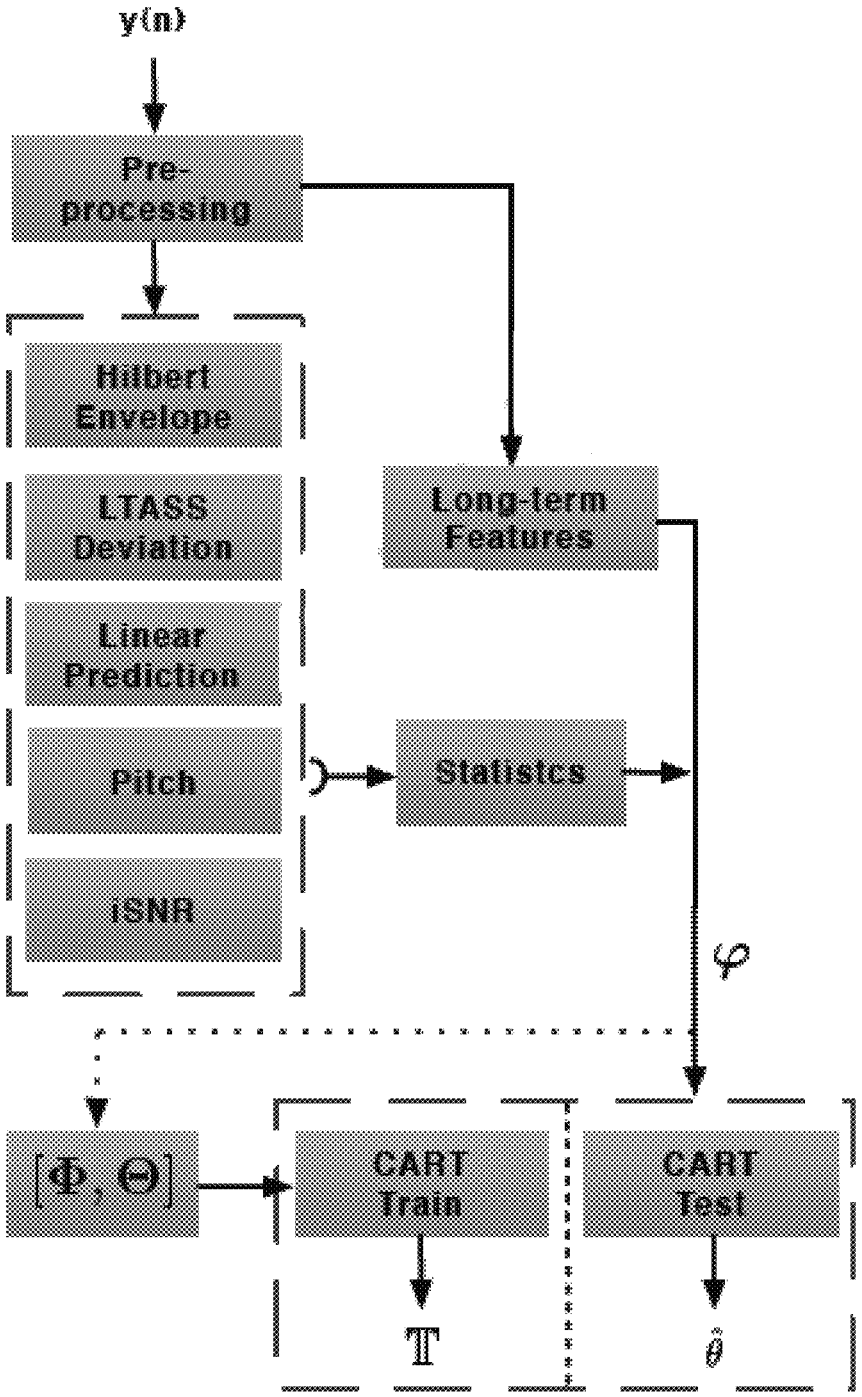
FIG. 4 is a diagrammatic view of an example of a speech classification process in accordance with an embodiment of the present disclosure.
Figure 5:
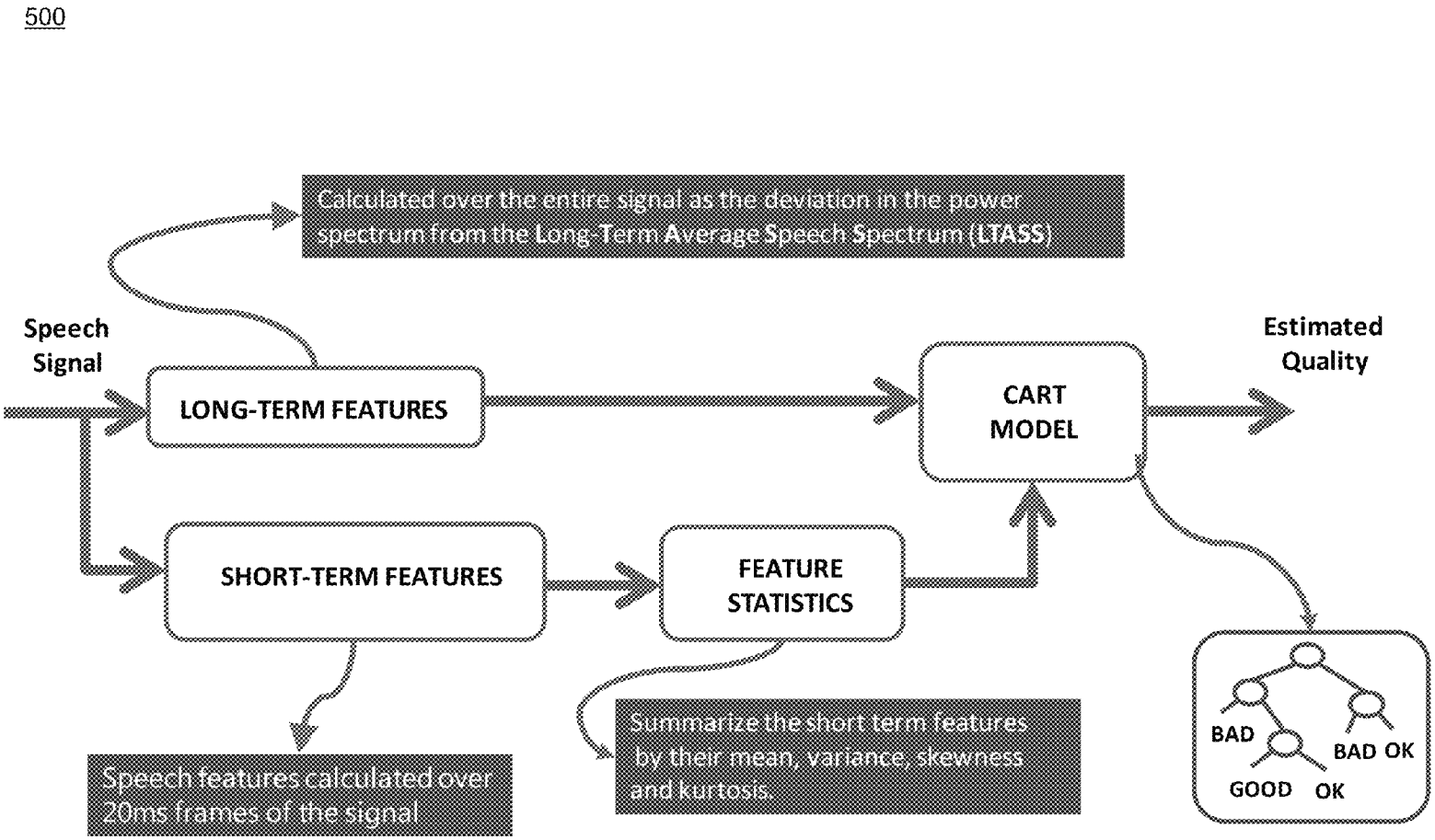
FIG. 5 is a diagrammatic view of an example of a speech classification process in accordance with an embodiment of the present disclosure.
Figure 6:
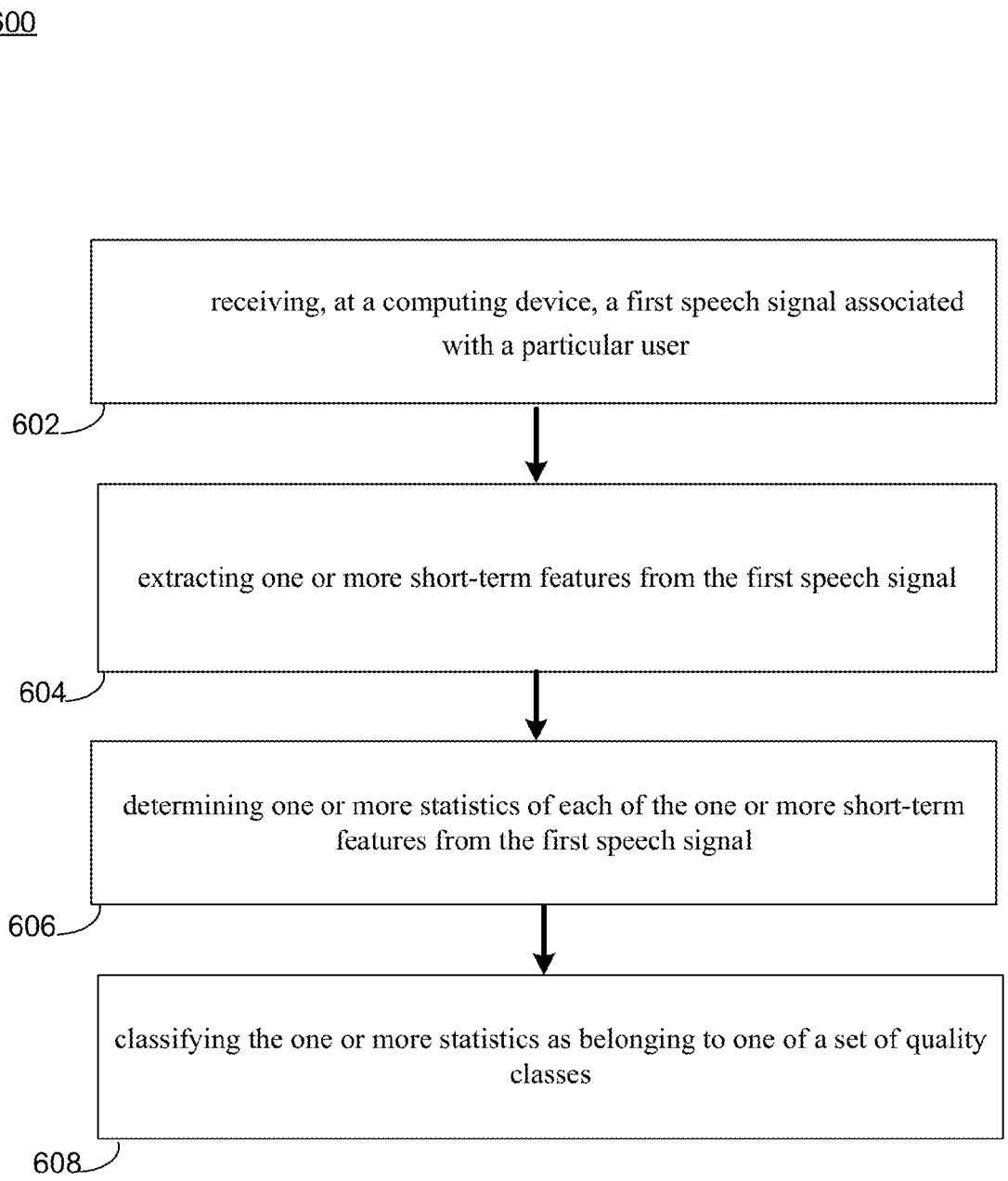
FIG. 6 is a flowchart of a speech classification process in accordance with an embodiment of the present disclosure.

Referring now to FIGS. 4-5, embodiments of speech classification process are shown. In some embodiments, speech classification process 10 may include, in whole, or in part, one or more Quality of Service ("QOS") algorithms. In operation, speech classification process 10 may include receiving (602), at a computing device, a first speech signal associated with a particular user. As discussed above, in some embodiments the speech signal may be associated with a voicemail.

In some embodiments, the QOS algorithm may include a data-driven, machine learning approach that uses a combination of feature extraction followed by a tree based classification model. In this way, speech classification process 10 may include extracting (604) one or more short-term features from the first speech signal wherein extracting short-term features includes extracting a time frame of between 10-50 ms.

In one particular implementation, 20 ms time frames may be used without departing from the scope of the present disclosure. In this particular example, the first step may include the short-time segmentation of the input signal y(n) into 20 ms frames by applying a non-overlapping Hanning window. The resulting signal may be denoted as y(i), where i is a 20 ms frame. The second step may include application of a Voice Activity Detector (VAD) based on the P.56 method to select frames where speech is present. The VAD may refer to a basic energy based method that first computes the speech level of the entire signal using the P.56 method and selects those frames that have a speech level within a range dependent on the P.56 level. The next step may include a normalization of the energy in the speech active frames to make the feature extraction that follows gain independent. This may then be followed by short-term feature extraction and the statistics of the short-term features may be determined (606) and used to characterize the entire signal and combined with the long-term features based on the Long Term Average Speech Spectrum (LTASS) to create the final feature vector, $\phi$, for the current signal. The features, $\phi$, may be used to infer a trained CART classification model, that has been previously trained on a feature matrix, $\Phi$, with corresponding ground truth scores from a training database. Some statistics may include, but are not limited to, mean, variance, skewness, and kurtosis.

In some embodiments, the short-term feature extraction may follow the time segmentation of the input speech signal into voice active frames and are described as follows. Some short-term features may include, but are not limited to, linear predictive coding residual, pitch frequency, Hilbert envelope, zero crossing rate, importance weighted signal to noise ratio, and difference from long-term average speech magnitude spectrum features. In some embodiments, the difference from long-term average speech magnitude spectrum may include at least one of flatness, centroid, and a power spectrum of long term deviation.

Pitch is a feature that may be used in accordance with speech classification process 10. The task of pitch estimation in low SNR scenarios is a challenging problem, where many pitch estimation algorithms fail. The QOS method makes use of pitch estimates, and rate of change of pitch, obtained from the RAPT algorithm.

The Importance weighted signal to noise ratio (iSNR) is another feature that may be used in accordance with speech classification process 10. The SNR may refer to an intrusive measure of the relative level of distortion in the signal, where the noise and speech power is known. The following additive model for the noise signal is assumed, $y(n)=s(n)+v(n)$, where $y(n)$ is the noisy speech signal, $s(n)$ the clean speech signal and $v(n)$ is the noise signal and $Y(i, k)$ refers to the Discrete Fourier Transform (DFT) of the noisy signal at time frame i and frequency bin k. The noisy speech power is defined as $P_y(i,k)=Y(i,k)\times Y^*(i,k)$. The iSNR feature used in QOS is a non-intrusive SNR measure that performs the SNR calculation in short-time frames and also applies a frequency weighting function based on speech intelligibility measurement. The iSNR feature uses the ⅓ octave frequency band importance function from the SII standard that applies more weight to frequencies that have a higher importance to speech intelligibility. The iSNR for time frame i may be defined as:

$$iSNR(i) = 10\times\sum_{k=1}^{N_k} I(k)\times\log_{10}\left(\frac{\max(0,\ P_y(i,k)-P_{\ddot{u}}(i,k))}{P_{\ddot{u}}(i,k)}\right) \tag{12}$$

where $I(k)$ is the SII weighting function, $N_k$ is the number of frequency bands, $P_{\ddot{u}}(i, k)$ is the estimated noise power spectrum obtained by the minimum statistics algorithm and $P_y(i, k)$ is the power spectrum of the noisy speech signal. Additionally, the rate of change of the iSNR feature over all voiced frames may be computed.

The Hilbert envelope is another feature that may be used in accordance with speech classification process 10. The Hilbert decomposition of a signal may result in a slowly varying envelope and a rapidly varying fine structure component. The envelope has been shown to be an important factor in speech reception. The envelope for frame i is calculated as:

$$e(i)=\sqrt{y(i)^2+\mathcal{H}\ (y(i))^2}, \tag{13}$$

where $e(i)$ is the envelope of the $i^{th}$ frame of $y(n)$ and $H\{\ \}$ is the Hilbert Transform. The variance ($\sigma_{e(i)}$) and dynamic range ($\Delta_{e(i)}$) of the envelope for each of the $N_1$ frames may be computed as follows:

$$\sigma_{e(i)} = \frac{1}{N_i}\sum_{i=1}^{N_1}(e(i)-\mu_{e(i)})^2 \tag{14}$$

$$\Delta_{e(i)} = |\max(e(i)) - \min(e(i))|. \tag{15}$$

LTASS deviation is another feature that may be used in accordance with speech classification process 10. The long term average speech magnitude spectrum (LTASS) has a characteristic shape that is often used as a model for the clean speech spectrum and has been used in a number of speech processing algorithms, such as blind channel identification. The ITU-T P.50 standard defines an analytic expression for approximating LTASS. The Power spectrum of Long term Deviation (PLD) feature for frame i and frequency bin k is defined as:

TABLE 3

The 20 per-frame features used in the QOS algorithm

| Feature description | Feature | Rate of change of feature |
|---|---|---|
| Zero crossing rate | $\phi_1$ | $\phi_{11}$ |
| Excitation variance | $\phi_2$ | $\emptyset_{12}$ |
| Speech variance | $\phi_3$ | $\phi_{13}$ |
| Pitch period | $\phi_4$ | $\phi_{14}$ |
| iSNR | $\phi_5$ | $\phi_{15}$ |
| Hilbert envelope variance | $\phi_6$ | $\phi_{16}$ |
| Hilbert enveloped dynamic range | $\phi_7$ | $\phi_{17}$ |
| PLD flatness | $\phi_8$ | $\phi_{18}$ |
| PLD dynamics | $\phi_9$ | $\phi_{19}$ |
| PLD centroid | $\phi_{10}$ | $\phi_{20}$ |

$$PLD(i,k)=\log(P_y(i,k))-\log(P_{LTASS}(k)), \tag{16}$$

where $P_y(i,k)$ is the magnitude power spectrum of a noisy signal and $P_{LTASS}(k)$ is the LTASS power spectrum. This deviation spectrum measures the effects on the magnitude spectrum due to the distortion. The per-frame LTASS deviation spectrum is used to derive the spectral flatness (SF), spectral centroid (SC) and spectral dynamics (SD) features as defined below:

$$SF(i) = \frac{\exp\left(\frac{1}{N_k}\sum_{k=1}^{N_k}\log(PLD(i,k))\right)}{\frac{1}{N_k}\sum_{k=1}^{N_k}PLD(i,k)}, \tag{17}$$

$$SC(i) = \frac{\sum_{k=1}^{N_k}\omega(k)\times\log(PLD(i,k))}{\sum_{k=1}^{N_k}\log(PLD(i,k))}, \tag{18}$$

$$SD(i) = \frac{1}{N_k}\sum_{k=1}^{N_k}(\log(PLD(i,k)-\log(PLD(i,k)))^2, \tag{19}$$

where $\omega$ is a frequency index vector and $N_k$ is the number of FFT bins. The spectral flatness, dynamics and centroid of LTASS deviation spectrum and their rate of change are included as short-term features.

Linear predictive coding is another feature that may be used in accordance with speech classification process 10. A 10th order linear predictive coding (LPC) may be performed on the speech signal using the auto-correlation method. The residual variance and its rate of change over the utterance may be included as features. Here, the term "utterance" may refer to a segment of speech for which the measure of interest is assumed approximately constant. The duration of an utterance should be suitably long as to permit estimation of the various features to be employed. In some embodiments, utterance durations in the range 3 to 8 seconds may be employed. Long speech segments with varying quality may, without loss of generality, be segmented into shorter segments with less variability in the measure of interest.

Zero crossing rate is another feature that may be used in accordance with speech classification process 10. The zero crossing rate has been successfully used as a feature for voiced-unvoiced speech and silence classification and is also expected to be a useful feature for speech quality assessment.

In some embodiments, LTASS deviation may be used as a long-term feature in accordance with speech classification process 10. The long-term deviation of the magnitude spectrum of the signal (calculated over the entire utterance) is defined as follows $$P_{LTLD}(k) = \frac{1}{N_i}\sum_{i=1}^{N_1} PLD(i, k) \tag{20}$$

where k if the frequency index, PLD is the power spectrum of long-term deviation. The resulting $P_{LTLD}$ spectrum is then mapped into 16 bins each with a bandwidth of 500 Hz and 50% overlap. The energy in each bin as a percentage of the total energy is then computed to form the long term features in QOS, as follows:

$$\phi_j = \frac{\sum_{g\in\omega} P_{LTLD}(g)}{\sum_{k=1}^{K} P_{LTLD}(k)}, \tag{21}$$

where $\phi_j$ is the $j^{th}$ global feature and ω is a 500 Hz window centered on the frame of interest and the numerator is the energy of the current frame and the numerator is the total energy in the residual spectrum. It is expected that this feature can identify the long-term frequency characteristics of different types of degradations.

In some embodiments, speech classification process 10 may classify the one or more statistics as belonging to one of a set of quality classes. The classes used in the listening test might be traditional MOS integers (1-5) and/or any other classification such as red, amber, green (traffic/stop lights). Where the received speech is associated with a voicemail, the classification approach may simplify the processing of the voice-mail message in the pipeline and also gives a more meaningful feedback to the customer. As discussed herein, classifying may be based upon, at least in part, non-intrusive classification of voicemail message quality. In some embodiments, the classification may be performed per each time frame.

In some embodiments, speech classification process 10 may use a binary tree classifier to model the speech quality class directly. Current methods estimate a continuous speech quality metric, typically on the MOS score, providing a score in the range from 1 to 5. Accordingly, the use of a classification block rather than a quality determination block may be of benefit to a live service such as voicemail to text because it may provide a go/no go decision for conversion (or traffic light).

As discussed herein, speech classification process 10 may rely upon both long-term (e.g. Deviation from LTASS based long-term features (e.g., percentage energy per frequency band), etc.) and short-term features (e.g., Hilbert envelope based features such as dynamic range and variance, Deviation from LTASS based short-term features such as Flatness, Centroid, Dynamics of the PLD, etc).

In some embodiments, speech classification process 10 may employ an intrusive speech quality algorithm to automatically label large training databases. In this way, large amounts of training data may be generated at a low cost. Speech classification process 10 may require low computational complexity and may be data-driven, so that it may be trained specifically for a target domain and tuned for particular networks.

In some embodiments, speech classification process 10 may provide active feedback of the speech quality in a voice-mail message, which may help inform customer expectation of the conversion quality in a voicemail to text message system. In this way, the message quality classification system described herein may be used to optimize the conversion process. Accordingly, it may be possible to train models for each message class and then using the quality score obtain better conversion quality.

In some embodiments, the quality score may help guide possible speech enhancement automatically for any speech to text system, including, but not limited to, agent based transcription or ASR, helping to improve output quality and reducing conversion time.

The teachings of the present disclosure may be used in any number of different applications and in numerous implementations. For example, in the general telecommunications context, speech classification process 10 may be licensed to network operators as a tool for monitoring speech quality in the infrastructure. Additionally and/or alternatively, speech classification process 10 may also be integrated as a smartphone application for monitoring the speech quality of a voice call.

Embodiments of speech classification process 10 may utilize stochastic data models, which may be trained using a variety of domain data. Some modeling types may include, but are not limited to, acoustic models, language models, NLU grammar, etc.

As discussed above, any or all of the operations and methodologies included herein are not limited to voicemail and may be used in accordance with any system or application (e.g. speech to text systems, under a license to network operators, etc.).

Figure 7:
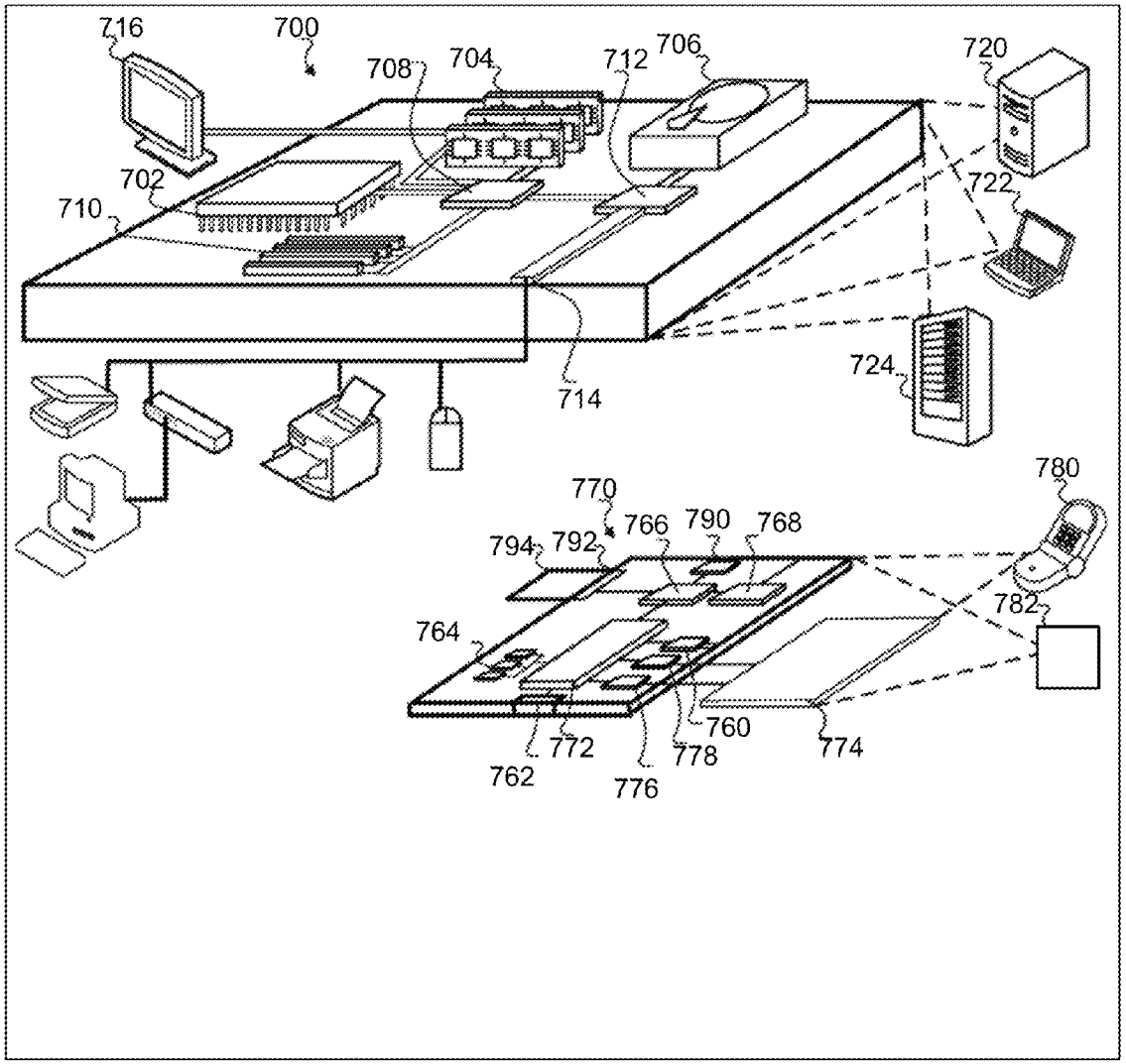
FIG. 7 shows an example of a computer device and a mobile computer device that can be used to implement the speech classification process described herein.

Referring now to FIG. 7, an example of a generic computer device 700 and a generic mobile computer device 770, which may be used with the techniques described here is provided. Computing device 700 is intended to represent various forms of digital computers, such as tablet computers, laptops, desktops, workstations, personal digital assistants, servers, blade servers, mainframes, and other appropriate computers. In some embodiments, computing device 770 can include various forms of mobile devices, such as personal digital assistants, cellular telephones, smartphones, and other similar computing devices. Computing device 770 and/or computing device 700 may also include other devices, such as televisions with one or more processors embedded therein or attached thereto. The components shown here, their connections and relationships, and their functions, are meant to be exemplary only, and are not meant to limit implementations of the inventions described and/or claimed in this document.

In some embodiments, computing device 700 may include processor 702, memory 704, a storage device 706, a high-speed interface 708 connecting to memory 704 and high-speed expansion ports 710, and a low speed interface 712 connecting to low speed bus 714 and storage device 706. Each of the components 702, 704, 706, 708, 710, and 712, may be interconnected using various busses, and may be mounted on a common motherboard or in other manners as appropriate. The processor 702 can process instructions for execution within the computing device 700, including instructions stored in the memory 704 or on the storage device 706 to display graphical information for a GUI on an external input/output device, such as display 716 coupled to high speed interface 708. In other implementations, multiple processors and/or multiple buses may be used, as appropriate, along with multiple memories and types of memory. Also, multiple computing devices 700 may be connected, with each device providing portions of the necessary operations (e.g., as a server bank, a group of blade servers, or a multiprocessor system).

Memory 704 may store information within the computing device 700. In one implementation, the memory 704 may be a volatile memory unit or units. In another implementation, the memory 704 may be a non-volatile memory unit or units. The memory 704 may also be another form of computer-readable medium, such as a magnetic or optical disk.

Storage device 706 may be capable of providing mass storage for the computing device 700. In one implementation, the storage device 706 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 704, the storage device 706, memory on processor 702, or a propagated signal.

High speed controller 708 may manage bandwidth-intensive operations for the computing device 700, while the low speed controller 712 may manage lower bandwidth-intensive operations. Such allocation of functions is exemplary only. In one implementation, the high-speed controller 708 may be coupled to memory 704, display 716 (e.g., through a graphics processor or accelerator), and to high-speed expansion ports 710, which may accept various expansion cards (not shown). In the implementation, low-speed controller 712 is coupled to storage device 706 and low-speed expansion port 714. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 700 may be implemented in a number of different forms, as shown in the figure. For example, it may be implemented as a standard server 720, or multiple times in a group of such servers. It may also be implemented as part of a rack server system 724. In addition, it may be implemented in a personal computer such as a laptop computer 722. Alternatively, components from computing device 700 may be combined with other components in a mobile device (not shown), such as device 770. Each of such devices may contain one or more of computing device 700, 770, and an entire system may be made up of multiple computing devices 700, 770 communicating with each other.

Computing device 770 may include a processor 772, memory 764, an input/output device such as a display 774, a communication interface 766, and a transceiver 768, among other components. The device 770 may also be provided with a storage device, such as a microdrive or other device, to provide additional storage. Each of the components 770, 772, 764, 774, 766, and 768, may be interconnected using various buses, and several of the components may be mounted on a common motherboard or in other manners as appropriate.

Processor 772 may execute instructions within the computing device 770, including instructions stored in the memory 764. The processor may be implemented as a chipset of chips that include separate and multiple analog and digital processors. The processor may provide, for example, for coordination of the other components of the device 770, such as control of user interfaces, applications run by device 770, and wireless communication by device 770.

In some embodiments, processor 772 may communicate with a user through control interface 778 and display interface 776 coupled to a display 774. The display 774 may be, for example, a TFT LCD (Thin-Film-Transistor Liquid Crystal Display) or an OLED (Organic Light Emitting Diode) display, or other appropriate display technology. The display interface 776 may comprise appropriate circuitry for driving the display 774 to present graphical and other information to a user. The control interface 778 may receive commands from a user and convert them for submission to the processor 772. In addition, an external interface 762 may be provide in communication with processor 772, so as to enable near area communication of device 770 with other devices. External interface 762 may provide, for example, for wired communication in some implementations, or for wireless communication in other implementations, and multiple interfaces may also be used.

In some embodiments, memory 764 may store information within the computing device 770. The memory 764 can be implemented as one or more of a computer-readable medium or media, a volatile memory unit or units, or a non-volatile memory unit or units. Expansion memory 774 may also be provided and connected to device 770 through expansion interface 772, which may include, for example, a SIMM (Single In Line Memory Module) card interface. Such expansion memory 774 may provide extra storage space for device 770, or may also store applications or other information for device 770. Specifically, expansion memory 774 may include instructions to carry out or supplement the processes described above, and may include secure information also. Thus, for example, expansion memory 774 may be provide as a security module for device 770, and may be programmed with instructions that permit secure use of device 770. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 764, expansion memory 774, memory on processor 772, or a propagated signal that may be received, for example, over transceiver 768 or external interface 762.

Device 770 may communicate wirelessly through communication interface 766, which may include digital signal processing circuitry where necessary. Communication interface 766 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 768. In addition, short-range communication may occur, such as using a Bluetooth, WiFi, or other such transceiver (not shown). In addition, GPS (Global Positioning System) receiver module 770 may provide additional navigation- and location-related wireless data to device 770, which may be used as appropriate by applications running on device 770.

Device 770 may also communicate audibly using audio codec 760, which may receive spoken information from a user and convert it to usable digital information. Audio codec 760 may likewise generate audible sound for a user, such as through a speaker, e.g., in a handset of device 770. Such sound may include sound from voice telephone calls, may include recorded sound (e.g., voice messages, music files, etc.) and may also include sound generated by applications operating on device 770.

Computing device 770 may be implemented in a number of different forms, as shown in the figure. For example, it may be implemented as a cellular telephone 780. It may also be implemented as part of a smartphone 782, personal digital assistant, remote control, or other similar mobile device.

Figure 8:
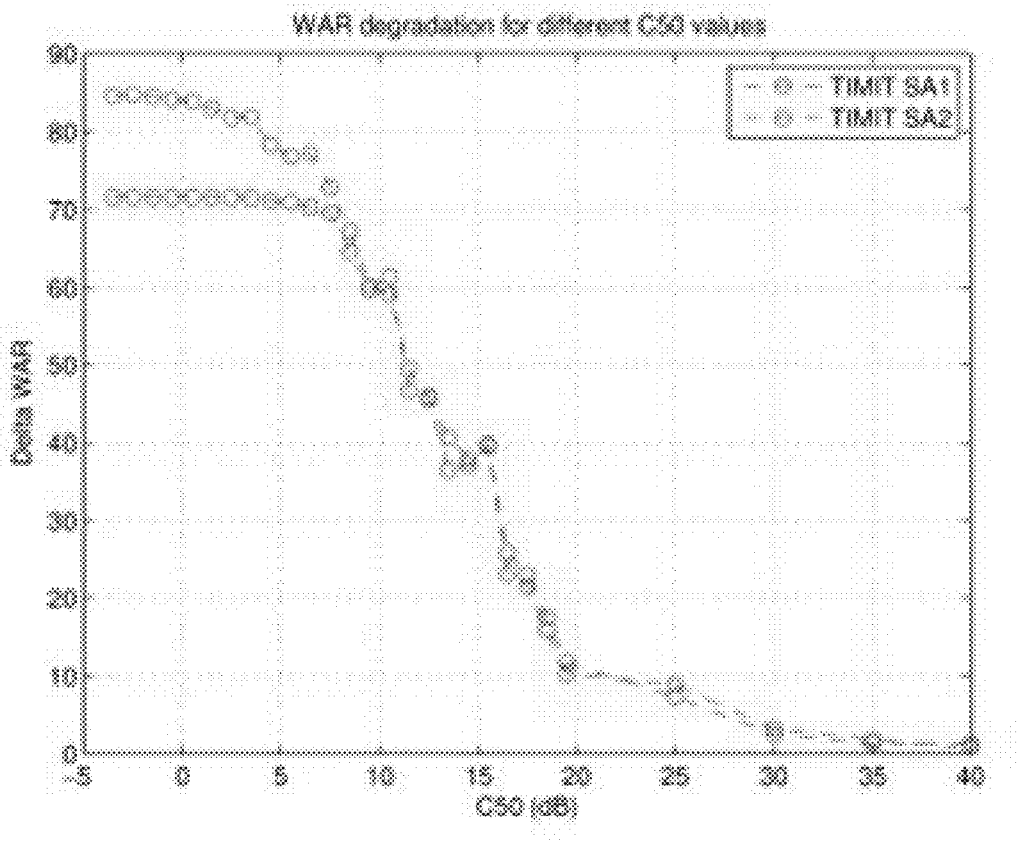
FIG. 8 shows a graphical representation depicting an example showing the unwrapped Hilbert phase for a speech file under three different reverberant conditions.
Figure 9:
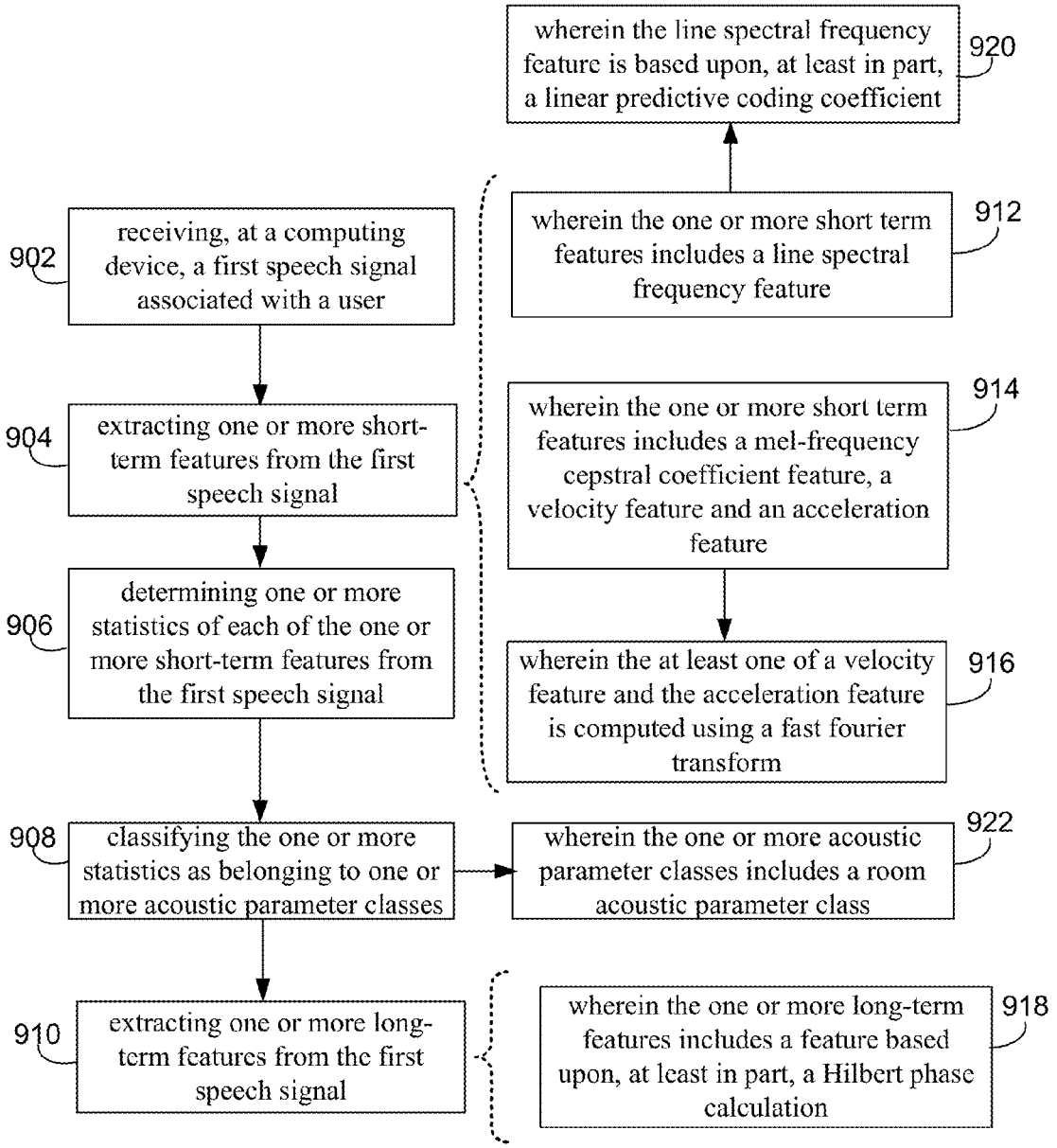
FIG. 9 is a flowchart of a speech classification process having non-intrusive acoustic parameter estimation capabilities in accordance with an embodiment of the present disclosure.

Referring also to FIGS. 8-9, embodiments of speech classification process 10 may be configured to estimate parameters from the speech signal that may describe the acoustic properties of the space in which a speech signal is recorded. The estimated parameters may be used for enhancing the speech signal by, for example, applying de-reverberation algorithms as well as optimizing the performance of ASR systems by using acoustic models derived from reverberant speech (e.g. choosing distant or close talking models for speech recognition software, dictation software, etc.).

As discussed herein, the acoustic properties of an enclosed space have an impact on a recorded speech signal, resulting in the perceptual effects of reverberation and coloration, which are caused by the reflections of the speech signal from surfaces in the room. Such effects can affect the performance of many speech processing systems, for example, in Automatic Speech Recognition (ASR), the acoustic properties of the room have an impact on ASR performance. The acoustic properties of a room can be characterized by a Room Impulse Response (RIR). A number of measures for characterizing the properties of a room have been proposed, however many of those methods rely on a reference clean signal, or an estimate of the RIR. The reverberation time ($T_{60}$) parameter has been widely used to characterize the acoustic properties of a room.

Embodiments disclosed herein may be non-intrusive in nature, in the sense that the process may require only the degraded speech signal to estimate the room acoustic parameters (without an estimate of the clean speech signal or the RIR).

Embodiments of speech classification process 10 may include a non-intrusive room acoustics (NIRA) algorithm, which may include a machine learning framework for room acoustic parameter estimation using a number of signal features and a CART model. In some embodiments, this may include short-time segmentation of the speech signal into 20 ms non-overlapping frames from which a 73 dimensional per frame feature vector is extracted. This feature vector may include the features proposed in the NIRA algorithm as well as Line Spectrum Frequency (LSF), Mel-Frequency Cepstral Coefficients (MFCC) and Hilbert phase based features. The resulting 73 per-frame features are summarized in Table 1. These may be characterized by their mean, variance, skewness and kurtosis, resulting in 296 global features. Additionally, 16 features characterizing the long-term spectral deviation may be calculated and included with a novel feature computed from the slope of the unwrapped Hilbert phase of the signal, resulting in 309 global features, which may be used to train a CART regression tree along with the class labels for the training data.

TABLE 1

An example of a 73 per-frame feature set that may be used in accordance with an NIRA algorithm

| Feature description | Feature | Rate of change of feature |
|---|---|---|
| LSF coefficients | $\varnothing_{1:10}$ | $\varnothing_{20:29}$ |
| Zero crossing rate | $\varnothing_{11}$ | $\varnothing_{30}$ |
| Speech variance | $\varnothing_{12}$ | $\varnothing_{31}$ |
| Pitch period | $\varnothing_{13}$ | $\varnothing_{32}$ |
| iSNR | $\varnothing_{14}$ | $\varnothing_{33}$ |
| Hilbert envelope variance | $\varnothing_{15}$ | $\varnothing_{34}$ |
| Hilbert envelope dynamic range | $\varnothing_{16}$ | $\varnothing_{35}$ |
| Spectral flatness (PLD) | $\varnothing_{17}$ | $\varnothing_{36}$ |
| Spectral dynamics (PLD) | $\varnothing_{18}$ | — |
| Spectral centroid (PLD) | $\varnothing_{19}$ | $\varnothing_{37}$ |
| Mel-Frequency Cepstral Coefficients | $\varnothing_{38:73}$ | — |

As discussed above, embodiments of speech classification process 10 may include extracting one or more short-term features from a first speech signal. In some embodiments, extracting these short-term features may be performed within a particular time frame (e.g. between 10-50 ms). The short-term feature extraction may follow the time segmentation of the input speech signal into voice active frames.

In some embodiments, some short-term features associated with speech classification process 10 may include LSF features. In this way, the 10th order LPC coefficients may be mapped to their LSF representations. LSFs are a transformation of the LPC coefficients that guarantee a stable representation of the LPC model after quantization and have been successfully used in a number to speech processing applications such as speech coding and speech/music discrimination.

In some embodiments, some short-term features associated with speech classification process 10 may include Mel-Frequency Cepstral Coefficients ("MFCC") features. The 12th order MFCCs along with the velocity and acceleration features may be computed in a variety of ways (e.g. using FFT).

As discussed above, embodiments of speech classification process 10 may include extracting one or more long-term features from a first speech signal. In some embodiments, the long-term features may include a Hilbert phase based feature. The Hilbert phase may be computed as:

$$\varnothing_H(t)=\arctan(s_i(t)/s_r(t)) \quad (22)$$

where $s_r(t)$ represents the signal to be analyzed and $s_i(t)$ its Hilbert transform defined as:

$$s_i(t) = H(s_r(t)) = \frac{1}{\pi t}\int_{-\infty}^{+\infty}\frac{s_r(\tau)}{t-\tau}d\tau \quad (23)$$

This parameter was proven to be a relevant factor for sound localization. Since reverberant environments may produce a spatial spreading of the source (i.e. the sound is diffused throughout the room), hence Hilbert fine structure may be useful to estimate the reverberation level. FIG. 8 shows the behavior of the unwrapped Hilbert phase for the same clean speech file under three different reverberant conditions. The slope of this phase may increase with the reverberation level and therefore it may be used for estimating this room acoustic parameter.

Embodiments of speech classification 10 described herein may provide a single algorithm for estimating various room acoustic parameters. Speech classification process 10 may require a low computational complexity during run-time and may provide for ASR performance prediction under reverberant environments. In some embodiments, speech classification process 10 may be configured to automatically configure de-reverberation algorithms for Voice Quality Assurance (VQA). Speech classification process 10 may include intelligent acoustic model switching for robust ASR (e.g. switch between close-talk and far-field acoustic models).

Accordingly, embodiments of speech classification process 10 may be trained to estimate room acoustic parameters and may be configured to classify one or more of the features described herein into a room acoustic parameter. Some room acoustic parameters may include, but are not limited to, T60 classes, C50 classes, etc. More specifically, and by way of example, the NIRA algorithm described herein may be trained to estimate room acoustic parameters (e.g., T60, etc.). In this way, speech classification process 10 may be used to select one or more ASR acoustic models (e.g., using an estimate of a physical measure relating to room acoustics).

Additionally and/or alternatively, speech classification process 10 may utilize a Hilbert phase based feature and may be non-intrusive in nature, therefore requiring only the received speech signal. In some embodiments, speech classification process 10 may be trained on simulated data, allowing a large training set to be developed with low financial and time constraints.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A computer-implemented method for automatic speech recognition using a non-intrusive acoustic parameter estimation of a room without an estimate of a clean speech signal comprising:

receiving, at a computing device, a first degraded speech signal associated with a user;

extracting one or more short-term features from the first degraded speech signal, wherein the one or more short term features includes a line spectral frequency feature and at least one of a mel-frequency cepstral coefficient feature, a velocity feature and an acceleration feature;

extracting one or more long-term features from the first degraded speech signal wherein the one or more long-term features includes a feature based upon, at least in part, a Hilbert phase calculation;

determining one or more statistics of each of the one or more short-term features from the first degraded speech signal;

classifying the one or more statistics as belonging to one or more acoustic parameter classes;

selecting one or more automatic speech recognition (ASR) models based upon the one or more acoustic parameter classes; and performing automatic speech recognition based upon, at least in part, the selected one or more ASR models.

2. The method of claim 1, wherein the line spectral frequency feature is based upon, at least in part, a linear predictive coding coefficient.

3. The method of claim 1, wherein the one or more acoustic parameter classes includes a room acoustic parameter class.

4. The method of claim 1 wherein the at least one of a velocity feature and the acceleration feature is computed using a fast fourier transform.

5. The method of claim 1, further comprising:

automatically configuring one or more de-reverberation algorithms based upon, at least in part, the one or more acoustic parameter classes.

6. The method of claim 1, wherein selecting one or more automatic speech recognition (ASR) models is based upon the one or more acoustic parameter classes, wherein the one or more acoustic parameter classes comprises one or more statistics of each of the extracted short-term features and extracted long-term features.

7. The method of claim 1, wherein the classification of one or more statistics of each of the one or more extracted long-term features requires only the received first degraded speech signal, wherein the extracted long-term features from the first degraded speech signal is based upon a Hilbert phase calculation based on simulated data.

8. A non-transitory computer-readable storage medium having stored thereon instructions for automatic speech recognition using a non-intrusive acoustic parameter estimation of a room without an estimate of a clean speech signal, which when executed by a processor result in one or more operations, the operations comprising:

receiving, at a computing device, a first degraded speech signal associated with a user;

extracting one or more short-term features from the first degraded speech signal, wherein the one or more short term features includes a line spectral frequency feature and at least one of a mel-frequency cepstral coefficient feature, a velocity feature and an acceleration feature;

extracting one or more long-term features from the first degraded speech signal wherein the one or more long-term features includes a feature based upon, at least in part, a Hilbert phase calculation;

determining one or more statistics of each of the one or more short-term features from the first degraded speech signal;

classifying the one or more statistics as belonging to one or more acoustic parameter classes;

selecting one or more automatic speech recognition (ASR) models based upon the one or more acoustic parameter classes; and performing automatic speech recognition based upon, at least in part, the selected one or more ASR models.

9. The non-transitory computer-readable storage medium of claim 8, wherein the line spectral frequency feature is based upon, at least in part, a linear predictive coding coefficient.

10. The non-transitory computer-readable storage medium of claim 8, wherein the one or more acoustic parameter classes includes a room acoustic parameter class.

11. The non-transitory computer-readable storage medium of claim 8 wherein the at least one of a velocity feature and the acceleration feature is computed using a fast fourier transform.

12. The non-transitory computer-readable storage medium of claim 8, wherein operations further comprise:

automatically configuring one or more de-reverberation algorithms based upon, at least in part, the one or more acoustic parameter classes.

13. A system for automatic speech recognition using a non-intrusive acoustic parameter estimation of a room without an estimate of a clean speech signal comprising:

one or more processors configured to receive a first degraded speech signal associated with a particular user, the one or more processors further configured to extract one or more short-term features from the first degraded speech signal, wherein the one or more short term features includes a line spectral frequency feature and at least one of a mel-frequency cepstral coefficient feature, a velocity feature and an acceleration feature, the one or more processors further configured to extract one or more long-term features from the first degraded speech signal, wherein the one or more long-term features includes a feature based upon, at least in part, a Hilbert phase calculation, the one or more processors further configured to determine one or more statistics of each of the one or more short-term features from the first degraded speech signal, the one or more processors further configured to classify the one or more statistics as belonging to one or more acoustic parameter classes and wherein the one or more processors are further configured to select one or more automatic speech recognition (ASR) models based upon the one or more acoustic parameter classes and wherein the one or more processors are further configured to perform automatic speech recognition based upon, at least in part, the selected one or more ASR models.

14. The system of claim 13, wherein the one or more acoustic parameter classes includes a room acoustic parameter class.

15. The system of claim 13, wherein the one or more processors are further configured to automatically configure one or more de-reverberation algorithms based upon, at least in part, the one or more acoustic parameter classes.

* * * * *